US010087055B2

(12) United States Patent
Alsaker et al.

(10) Patent No.: US 10,087,055 B2
(45) Date of Patent: Oct. 2, 2018

(54) LOAD HANDLING DEVICE AND METHOD FOR USING THE SAME

(71) Applicant: MacGregor Norway AS, Kristiansand (NO)

(72) Inventors: Baard Trondahl Alsaker, Kristiansand (NO); Roland Verreet, Aachen (DE)

(73) Assignee: MacGregor Norway AS, Kristiansand (NO)

( * ) Notice: Subject to any disclaimer, the term of this patent is extended or adjusted under 35 U.S.C. 154(b) by 0 days.

(21) Appl. No.: 14/890,361

(22) PCT Filed: Jun. 19, 2014

(86) PCT No.: PCT/NO2014/050106
§ 371 (c)(1),
(2) Date: Nov. 10, 2015

(87) PCT Pub. No.: WO2014/204320
PCT Pub. Date: Dec. 24, 2014

(65) Prior Publication Data

US 2016/0107867 A1 Apr. 21, 2016

(30) Foreign Application Priority Data

Jun. 19, 2013 (NO) ..... 20130851

(51) Int. Cl.
*B66D 1/50* (2006.01)
*B66D 1/74* (2006.01)

(52) U.S. Cl.
CPC ..... *B66D 1/505* (2013.01); *B66D 1/741* (2013.01)

(58) Field of Classification Search
CPC ..... B66D 1/505; B66D 1/741; B66D 1/48; B66D 2700/0108; Y10S 254/90
See application file for complete search history.

(56) References Cited

U.S. PATENT DOCUMENTS 3,101,912 A * 8/1963 Bartlett ..... B65H 59/04 242/156.2
3,241,785 A * 3/1966 Barrett ..... B65H 23/1955 242/413.1
3,263,965 A * 8/1966 Mutch ..... B66C 13/00 254/281
3,309,065 A * 3/1967 Prud Homme ..... B65G 67/603 254/277

(Continued)

OTHER PUBLICATIONS

International Search Report for PCT/NO2014/050106 dated Sep. 29, 2014.

(Continued)

*Primary Examiner* — Michael E Gallion
(74) *Attorney, Agent, or Firm* — Andrus Intellectual Property Law, LLP

(57) ABSTRACT

A load handling device is for lifting and lowering a load. The load handling device includes an elongated member adapted to be connected to a load and a capstan, including one or more sheaves, through which the elongated member is running, the capstan defining a low tension side and high tension side of the elongated member. The load handling device further comprises a tension regulating member adapted to operate at the low tension side of the elongated member. A method is for lifting and lowering a load via a load handling device.

12 Claims, 12 Drawing Sheets

(56) References Cited

U.S. PATENT DOCUMENTS 3,343,810 A * 9/1967 Parnell ..... B63B 21/16 254/273
3,606,854 A * 9/1971 Van Lunteren ..... B63C 11/44 114/230.27
3,618,897 A * 11/1971 Swoboda, Jr. ..... B63B 21/16 254/270
3,653,636 A * 4/1972 Burrell ..... E21B 19/09 175/5
3,679,180 A * 7/1972 Callaghan ..... B64F 1/125 104/114
3,791,628 A * 2/1974 Burns ..... B66D 1/48 254/277
3,893,249 A * 7/1975 Wolters ..... E02F 9/067 175/5
3,918,653 A * 11/1975 Harms ..... B66D 1/741 226/169
3,927,867 A 12/1975 Herchenroder
4,147,330 A * 4/1979 Eik ..... B66D 1/52 254/266
4,234,167 A * 11/1980 Lane ..... B66D 1/741 254/291
4,349,179 A * 9/1982 Barber ..... B66C 13/02 114/245
4,379,615 A * 4/1983 Toda ..... B65H 75/4452 242/388.6
4,593,885 A * 6/1986 Hackman ..... B66C 13/02 254/277
4,678,132 A * 7/1987 Fowler ..... B65H 51/26 242/364.11
5,114,026 A * 5/1992 Van Ketel Hendrik ..... B66D 1/52 212/308
5,351,430 A * 10/1994 Hystad ..... A01K 73/06 254/273
5,470,005 A * 11/1995 King ..... B21C 47/003 226/1
5,673,143 A * 9/1997 Chin ..... G02B 23/12 250/368
6,926,260 B1 * 8/2005 De Groot ..... B66D 3/043 254/277
7,389,973 B1 * 6/2008 Chou ..... B66D 1/50 254/277
2002/0166917 A1 * 11/2002 Eagelman ..... B65H 49/32 242/421.7
2010/0262384 A1 * 10/2010 Marfani ..... B65H 59/40 702/43
2010/0308289 A1 * 12/2010 Dalsmo ..... B63B 27/10 254/270
2011/0260126 A1 * 10/2011 Willis ..... B66D 1/52 254/283
2015/0102152 A1 * 4/2015 Duehring ..... B65H 23/048 242/419.1

OTHER PUBLICATIONS

Written Opinion for PCT/NO2014/050106 dated Sep. 29, 2014.
Written Opinion for PCT/NO2014/050106 dated May 26, 2015.
International Preliminary Report on Patentability dated Sep. 2, 2015.

* cited by examiner

LOAD HANDLING DEVICE AND METHOD FOR USING THE SAME

CROSS-REFERENCE TO RELATED APPLICATIONS

This application is the U.S. national stage application of International Application PCT/NO2014/050106, filed Jun. 19, 2014, which international application was published on Dec. 24, 2014, as International Publication WO2014/204320 in the English language. The international application is incorporated herein by reference, in entirety. The international application claims priority to Norwegian Patent Application No. 20130851, filed Jun. 19, 2013, which is incorporated herein by reference, in entirety.

FIELD

There is described a load handling device for lifting and lowering a load. More specifically there is described a load handling device for lifting and lowering a load, where the load handling device comprises an elongated member adapted to be connected to a load, a capstan, including one or more sheaves, through which the elongated member is running, wherein the capstan defines a low tension side and a high tension side of the elongated member.

BACKGROUND

A capstan can be seen as a black box acting as a force amplifier or a force reducer for a rope, a wire, or any elongated member running therethrough. In the following the word "rope" shall be understood as including any elongated member adapted to be connected to and to carry a load. The force amplification or reduction through a capstan will follow the Eytelwein formula:

$$\frac{S_1}{S_2} \leq e^{\mu\alpha}$$

wherein S1 is the rope force acting on a high tension side of the capstan, S2 is the rope force acting on a low tension side of the capstan, $\mu$ is the friction coefficient, and $\alpha$ is the total angle swept by all turns of the rope measured in radians. The maximum rope force amplification or reduction will be reached when $$\frac{S_1}{S_2} \leq e^{\mu\alpha}$$

and the rope will start sliding. In the following the S1/S2 ratio will be called the amplification factor or reduction factor, depending on the direction of the travel of the rope. Because sliding of the rope is undesirable, capstan systems are typically overdesigned by letting the rope sweep one or more turns in addition to what is needed. The one or more additional turns will create more bends for the rope running through the capstan. Usually this is considered to be a small price to pay for having gained additional safety against sliding. For a load smaller than the maximum load of the system, the capstan will be even further overdesigned, doing several unnecessary turns around the capstan sheaves. Usually, this is also considered to be a small price to pay for gaining a high safety factor against sliding.

Overdesigning a capstan system, however, creates a number of drawbacks, some of which are not understood by most capstan designers, and which might even reduce the safety of the system. The drawbacks that are described in the following will typically be even more pronounced in offshore lifting devices comprising heave compensation systems for counteracting the heave acting on a vessel on which the lifting device is placed. The rope will be travelling back and forth in order to compensate for the heave motion of the vessel to keep the load stable relative to a seabed or to another vessel, and the rope will thus be exposed to a great number of bending cycles with the rope under high tension.

In a capstan system sheaves are typically arranged quite close to each other. The sheaves might be connected, such as in a double capstan system, or they might be individually driven, or the capstan might comprise a combination of the connected and individually driven sheave arrangements. If the motion of the rope is frequently reversed, such as in an above mentioned offshore heave compensated operation, this might lead to a premature failure of the rope.

When a rope is travelling back and forth in a capstan, the affected rope sections will be bent every time they enter a sheave and they will be straightened every time they leave a sheave. Due to the friction within the rope and between the rope and the sheaves, the affected rope sections and capstan sheaves will heat up. This might lead to a loss of lubricant, and as a consequence, to an accelerated degradation of the rope. Heat might also start a strain ageing process in the rope wires. The heating effects tend to increase with increasing rope diameter.

When a rope does more bending cycles than necessary, there is a risk that exponential force amplifications build up from both sides of the capstan, thus leading to a force peak in the capstan system. The rope travelling through the capstan then not only does more bending cycles than necessary but these bending cycles might be done under loads higher than what is considered to be a maximum rope force of the system. The combination of the unfortunate effects of excessive bending cycles and loads will lead to a much higher bending fatigue and, as a consequence, to a considerably reduced rope life. In several cases the rope force have increased to a level higher than the breaking strengths of the ropes, which have thus lead to overload failures of the ropes within the capstan system. Some failures of capstan orientation/axes might also be the consequence of the fact that the rope forces in the system were much higher than what the designer had predicted.

Yet another drawback of the prior art arises from the fact that the force distribution in a capstan system is different when a load is lifted compared to when a load is lowered. This implies that every time the motion of the rope is reversed, the force on a section of a rope may be substantially increased or lowered. This will lead to a great amount of tension-tension fatigue which will add up to the already mentioned bending fatigue due to the superfluous sheaves. In addition the rope will continuously change its length while lying on a sheave in order to adapt to the changing rope forces, thus causing abrasion both on the rope and on the sheaves of the capstan.

The drawbacks of the prior art will also be described below with reference to the accompanying drawings.

SUMMARY

It is an object of the invention to remedy or to reduce at least one of the drawbacks of the prior art or at least to provide a useful alternative to the prior art.

The object is achieved by means of features which are disclosed in the following description and in the claims that follow.

In a first aspect the invention relates to a load handling device for lifting and lowering a load, the load handling device comprising:

an elongated member adapted to be connected to a load;

a capstan, including one or more sheaves, through which the elongated member is running, the capstan defining a low tension side and high tension side of the elongated member, wherein the load handling device further comprises a tension regulating member adapted to operate on the low tension side of the elongated member.

In one embodiment the load handling device may comprise one or more load sensing devices. The load sensing devices, which may be load cells as known in the art, may be provided on the low tension side and/or on the high tension side of the capstan. The one or more load sensing devices may be incorporated into one or more sheaves on the low tension side and/or on the high tension side of the capstan.

A control unit, such as a programmable logic controller or a microcontroller or the like, may be used to regulate the tension regulating member. Optionally the control unit can base its regulation of the tension regulating member on the sensed loads from the load sensing devices. The control unit may further be used to find/calibrate the amplification/reduction factor. After a few lifts or test lifts with the system, the control unit may know what the amplification or reduction factor of the system is, maybe even how the factor will change when using a dry rope or a wet rope. It could then just measure the rope force at the high tension side, divide it by this factor in order to determine the force at which the rope will start sliding and keep the rope force on the low tension side slightly above this level. Alternatively, a staring value for the amplification factor can be manually set and reduced until the rope starts sliding, then increasing the rope force slightly again so as to secure the load and ensure that the system is operated with an optimum rope force distribution.

The control unit may further be connected to a storage unit for storing data from previous operations. This may be beneficial for the load handling device for automatically adjusting to new conditions.

In one embodiment the tension regulating member may comprise a storage drum on which at least a part of the elongated member is stored. For lifting and lowering operations a storage drum may be sufficient for regulating the tension on the low tension side of the capstan. In heave compensation operations, on the other hand, the storage drum would be required to continuously rotate back and forth, which might be a problem due to the great inertias involved.

In one embodiment the tension regulating member may comprise a separate tension control system. The tension control system may be provided between the capstan and a storage drum. In a heave compensation operation, the capstan and the tension control system would move, while the big masses of the storage drum and the payload will not. The tension control system may comprise one or more displaceable sheaves, through which the elongated member is running, adapted to regulate the tension of the elongated member on the low tension side. In one specific embodiment the tension control system may consist of three sheaves. In the direction from the capstan towards the storage drum, the rope may travel 90° over a first sheave with a fixed position. The rope then travels 180° over a second sheave which can be moved up or down by a drive unit, such as hydraulic cylinder. Finally the rope travels 90° over a third sheave with a fixed position. The rope tension can be increased by lifting the middle sheave by means of the drive unit, thereby stretching the rope and increasing its tension. In a similar way, the rope tension can be reduced by lowering the second sheave by means of the drive unit.

The tension control system may be connected to a control unit.

In one embodiment the tension regulating member may comprise a sheave engaging and/or disengaging unit. In a capstan with individually controllable sheaves, one way of regulating the force on the low tension side could be to selectively engage and disengage the sheaves on the low tension side of the capstan. Disengagement of a sheave implies letting the sheave be free-wheeling. The disengaging unit may thus comprise the control unit individually controlling a drive unit for one or more of the sheaves in the capstan.

In one embodiment the tension regulating member may comprise a friction regulating unit. It is possible to regulate the tension on the low tension side also by controlling the friction of the rope. This may be done by means of a clamp acting normally on the elongated member so as to adjust the friction. Alternatively or in addition, the friction regulating unit may comprise one or more engageable and disengageable magnets acting normally on the elongated member. The friction regulating device may further comprise a lubricating unit.

In practical embodiments it may be challenging to control the adjustment of the tension of the rope by adjusting the friction. The amplification/reduction factor depends exponentially on the friction, and small changes in friction will lead to large changes in the amplification/reduction, thus making it challenging for the force regulating member to react fast enough. It may thus be beneficial to keep the capstan and the elongated member at a more or less constant friction, for instance by constantly wettening the capstan.

In one embodiment one or more sheaves of the capstan may at least partially be made from a material with a higher friction coefficient than that of steel, such as Becorit®. Becorit is known for having a high friction coefficient, much higher than that of steel, thus possibly reducing the number of required sheaves significantly. A reduced number of sheaves will reduce the bending fatigue of the elongated member. The one or more Becorit sheaves may preferably be provided on the low tension side of the rope, and the one or more Becorit sheaves may be engageable/disengageable as described above.

There is also described a vessel provided with a load handling device according to the above description.

In a second aspect the invention relates to a method for lowering and/or lifting a load by means of a load handling device according to claim 1 of the present invention, the method comprising the step of:

adjusting the tension on the high tension side of the elongated member by regulating the tension on the low tension side of the elongated member by means of the tension regulating member.

In one embodiment the method may comprise the step of:

adjusting the tension on the low tension side of the elongated member so that the force distribution in the elongated member in the capstan when lifting a load is essentially equal to the force distribution in the elongated member in the capstan when lowering the load. As will be described in the following with reference to the figures, this may significantly reduce the tension-tension fatigue of the rope.

Further the method may comprise the steps of:

by means of the tension regulating member increasing the tension on the low tension side of the elongated member when lowering the load compared to when lifting the load; and/or lowering the tension on the low tension side of the elongated member when lifting the load compared to when lowering the load. This may beneficially give both the advantage of lower overall load levels in the system as well as the advantage of smaller changes in the force distribution upon reversing the motion of the rope.

A great advantage of the present invention is that existing overdesigned capstan systems could be fitted with a load regulating member according to the above description and thus render possible reverse motion. The tension regulating member may ensure safe operation, and in many cases the number of wraps around the capstan may be reduced.

Once a capstan is provided with a tension regulating member on the low tension side of the rope, the capstan will be operated under lower rope forces compared to prior art, leading to longer rope life and reduced abrasion on both the rope and on the capstan sheaves. Peak loads in the system can be avoided.

BRIEF DESCRIPTION OF THE DRAWINGS

In the following examples of preferred embodiments are shown with reference to accompanying drawings where.

DETAILED DESCRIPTION OF THE DRAWINGS

Figure 1:
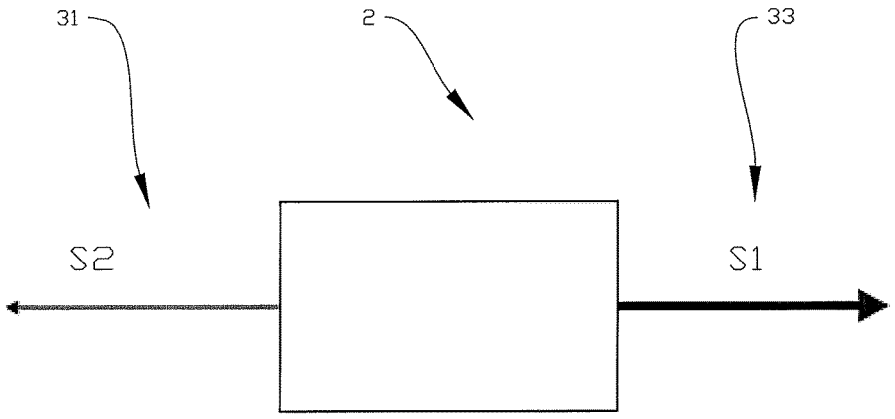
FIG. 1 shows schematically a rope running through a capstan as used with a load regulating device according to the present invention.

In the following the reference numeral 1 indicates a load handling device according to the present invention. Identical numerals refer to identical or similar parts, and the figures are shown schematically and simplified.

Figure 2:
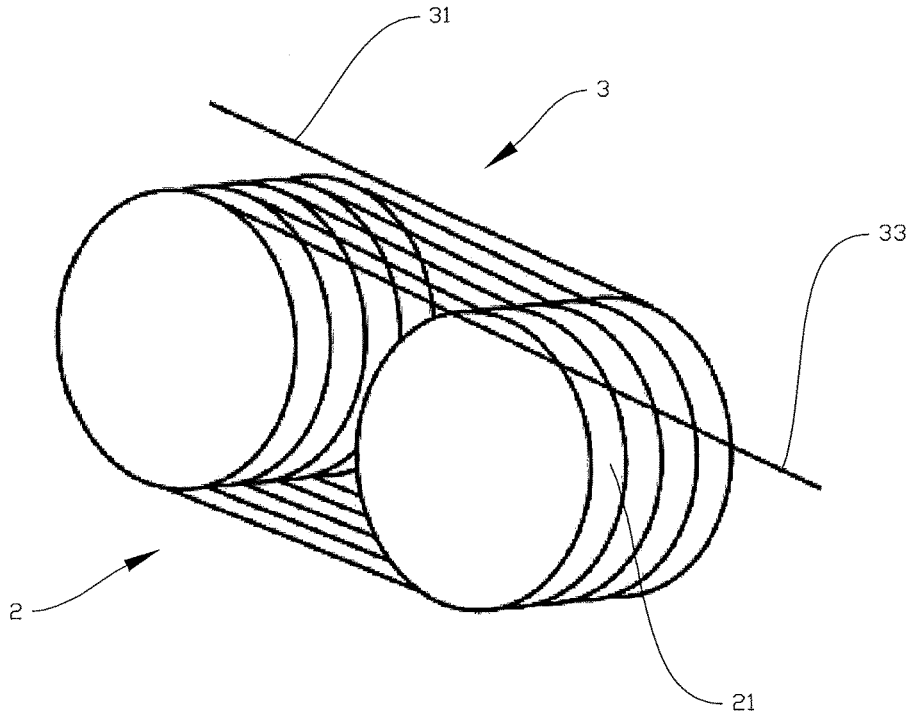
FIG. 2 shows in a perspective view a capstan as used with a load regulating device according to the present invention.

FIGS. 1 and 2 show a capstan 2, schematically and in perspective, respectively. The capstan 2 acts as a force amplifier or a force reducer for an elongated member 3 in the form of a rope running through the capstan 2. The capstan defines a low tension side 31 with a rope force S2 and a high tension side 33 with a rope force S1. When lifting a load 5, see FIGS. 11 and 12, the rope 3 enters the capstan 2 on the high tension side 33 and exits on the low tension side 31. Contrary, when lowering the load 5, the rope 3 enters the capstan 2 on the low tension side 31 and exits on the high tension side 33.

The rope 3 in the capstan 2 of FIG. 2 travels five full turns, i.e. 10 half turns, around sheaves 21 of the capstan 2, which is of a double drum type. The angle $\alpha$ in the exponent of the Eytelwein formula will thus be 10 times $\Pi$ ($\approx$31.4). A friction $\mu$ of 0.125 will be used in the following examples, hence the amplification factor S1/S2 will be approximately 51 in our examples.

Figure 3:
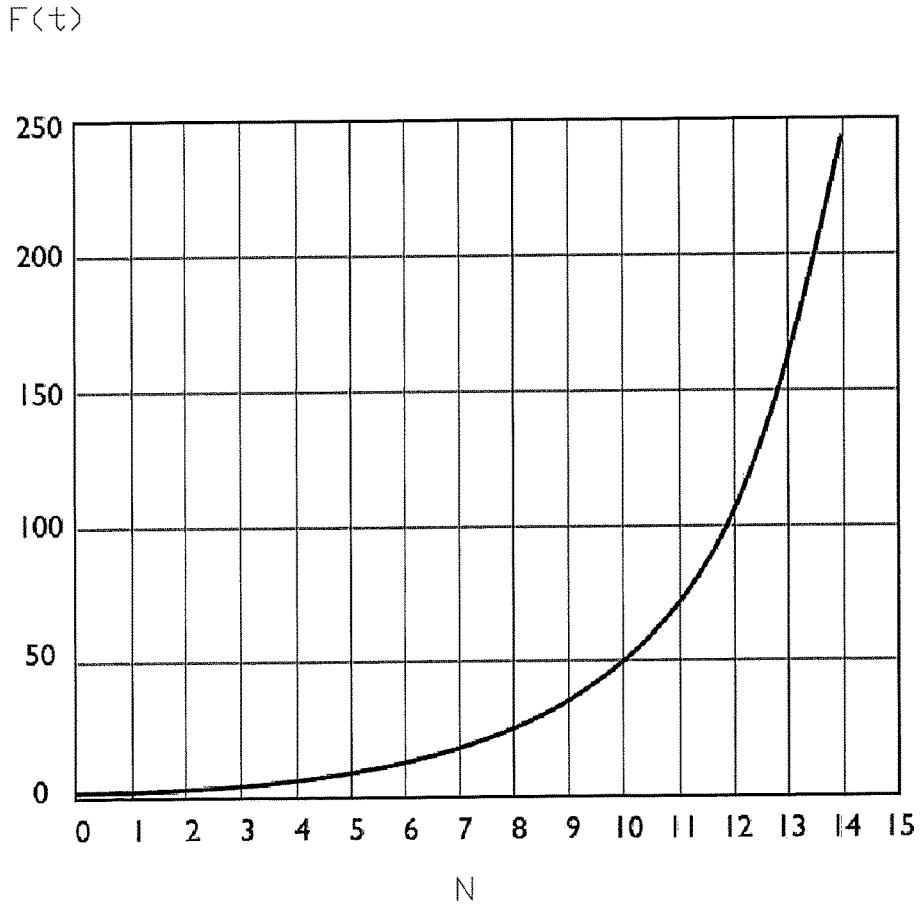
FIGS. 3-10 are graphs showing the force distribution on the rope in the capstan as a function of the number of half turns.

The graph in FIG. 3 shows the rope force F given in tons (t) in a capstan 2 in which the rope 3 travels seven full turns, i.e. 14 half turns, as a function of the number of half turns N, i.e. the number of sheaves 21 over which the rope runs. If setting the rope force on the low tension side 31 to 1 ton (1 t), the rope force on the high tension side 33 could be as high as 244 t before the rope 3 starts sliding, i.e. the amplification factor is 244. The exemplary system is designed for lifting loads 5 with a rope force S1 of 50 t, which would require five full rope turns around the capstan 2 only.

Figure 4:
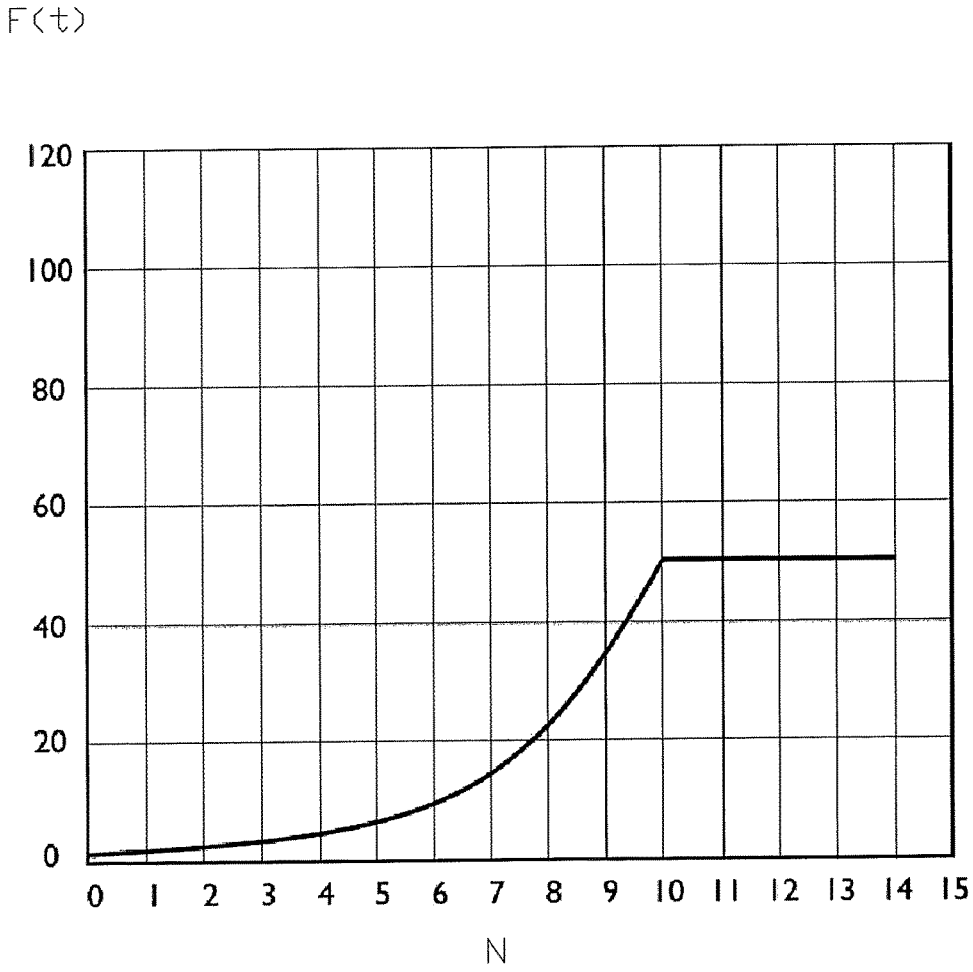

The graph of FIG. 4 shows a theoretical force reduction along the rope arcs around the capstan 2 from the low tension side 31 to the high tension side 33. The rope 3 enters on the high tension side 33 and travels over sheaves 14-11 with a force equal to that on the high tension side 33, i.e. 50*t*. According to the Eytelwein formula, the rope force will reduce according to the exponential function as described above until it reaches the lower force S2 of 1 t.

Figure 5:
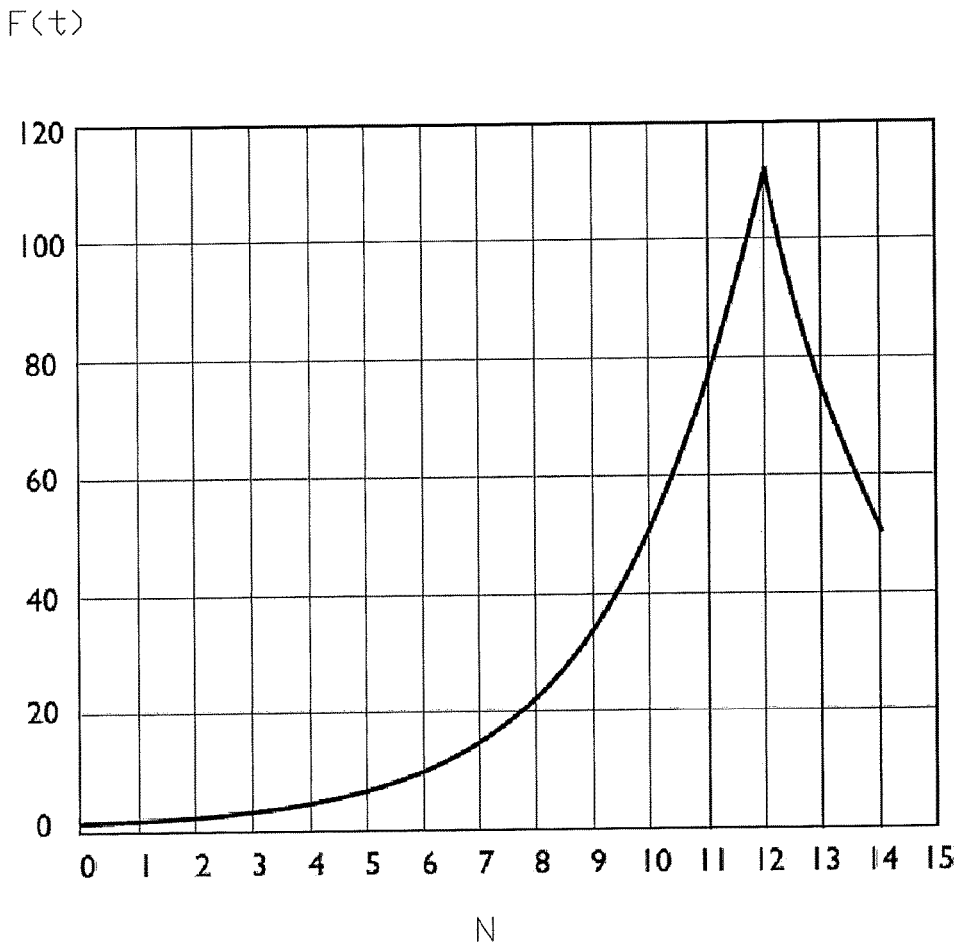

According to established theory which is the basis for the design of all capstans according to prior art, the maximum rope force in the system will always be found on the entrance of the capstan 2 when lifting a load 5 and on the exit of the capstan 2 when lowering a load 5. In practice, however, force distributions like the one shown in FIG. 5 can be found. An exponential function builds up from both sides of the capstan 2, creating a force peak inside the capstan 2. In this specific example the force peak on the $12^{th}$ sheave 21 will be more than twice as high the rope force on the high tension side 33. The rope 3 travelling through the capstan 2 will thus not only do four unnecessary half turns around the sheaves 21 of the capstan 2, the bending cycles will be done under loads higher than what is considered to be a maximum rope force of the system.

Figure 6:
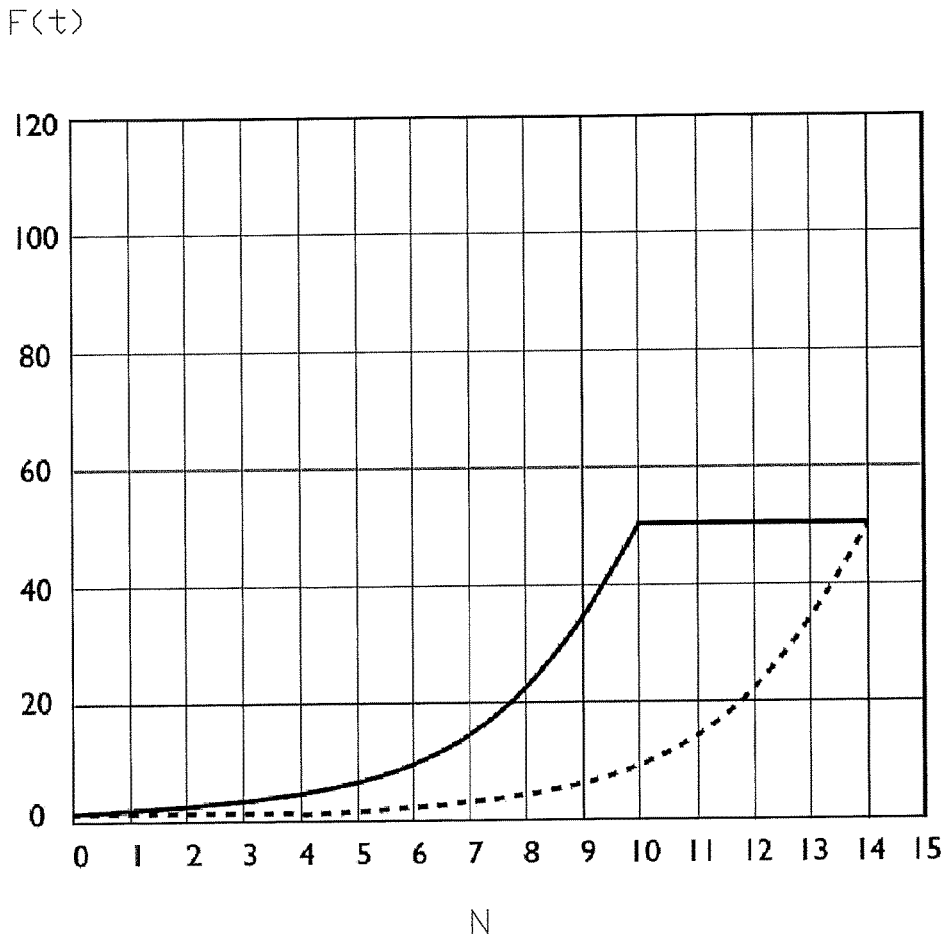

The graph in FIG. 6 shows the difference in force distribution on the rope 3 in the capstan 2 when lifting (solid line) compared to when lowering (dashed line) a load 5. The rope force on the high tension side 33 is 50 t, while the rope force on the low tension side 31 is 1 t. The capstan 2 may be working in heave compensation mode continuously switching between lifting and lowering the load 5. When lifting the load 5, the load 5 will enter the capstan 2 on the $14^{th}$ sheave 21 and travel with the same rope force over sheaves 14-11 until the force on the rope 3 falls off exponentially to it on the $1^{st}$ sheave 21. When lowering the load 5, the rope 3 will enter on the low tension side 31 of the capstan 2 and travel over sheaves 1-4 with a constant, low rope force of it until the force on the rope 3 increases exponentially to 50 t at the exit of the last sheave 21.

Figure 7:
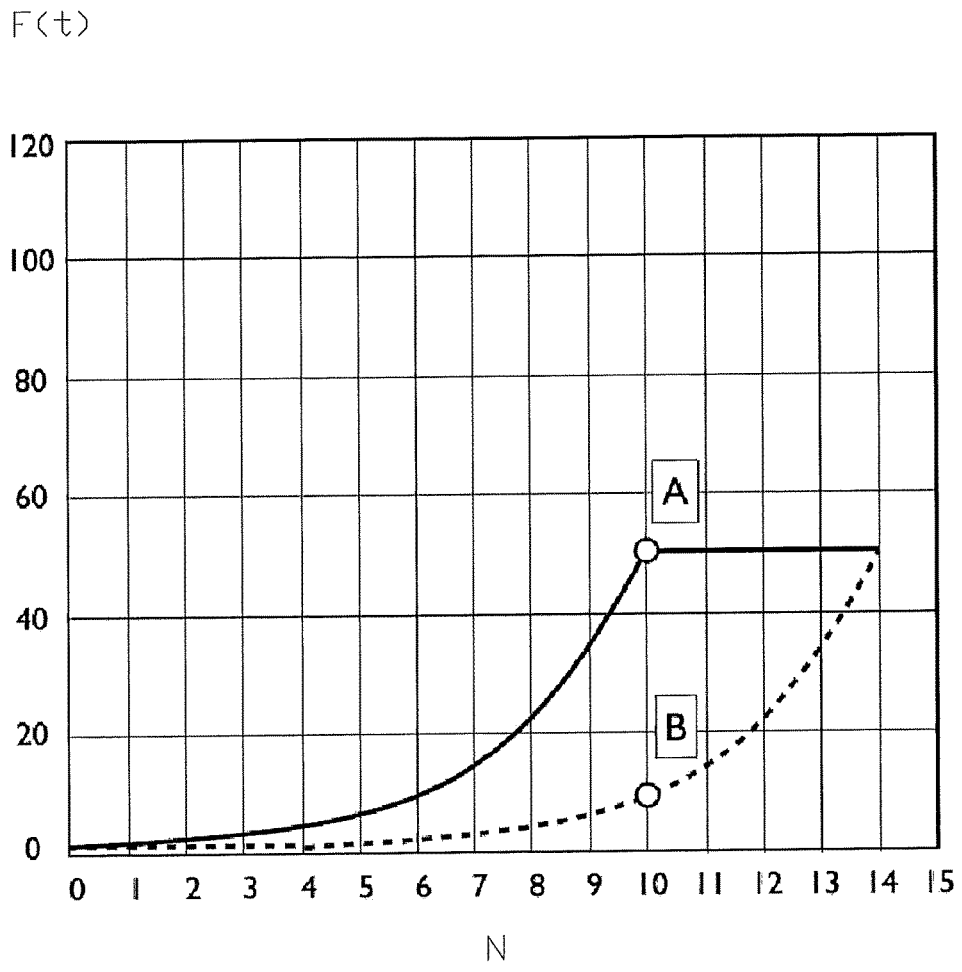

When lifting, the rope force on the $10^{th}$ sheave will have a rope force of 50 t, as indicated with the with letter A in FIG. 7. However, when lowering, the rope force on the $10^{th}$ sheave will be only 10.4 t, indicated by the letter B, meaning that the rope force on the same sheave 21 will be almost fivefold when lifting compared to when lowering. With the rope 3 repetitively lifting and lowering, the rope section around the $10^{th}$ sheave will be either in point A or in point B on the graph. As described above, this will lead to a great amount of tension-tension fatigue and additional abrasion on the rope 3 and on the sheaves 21.

Figure 8:
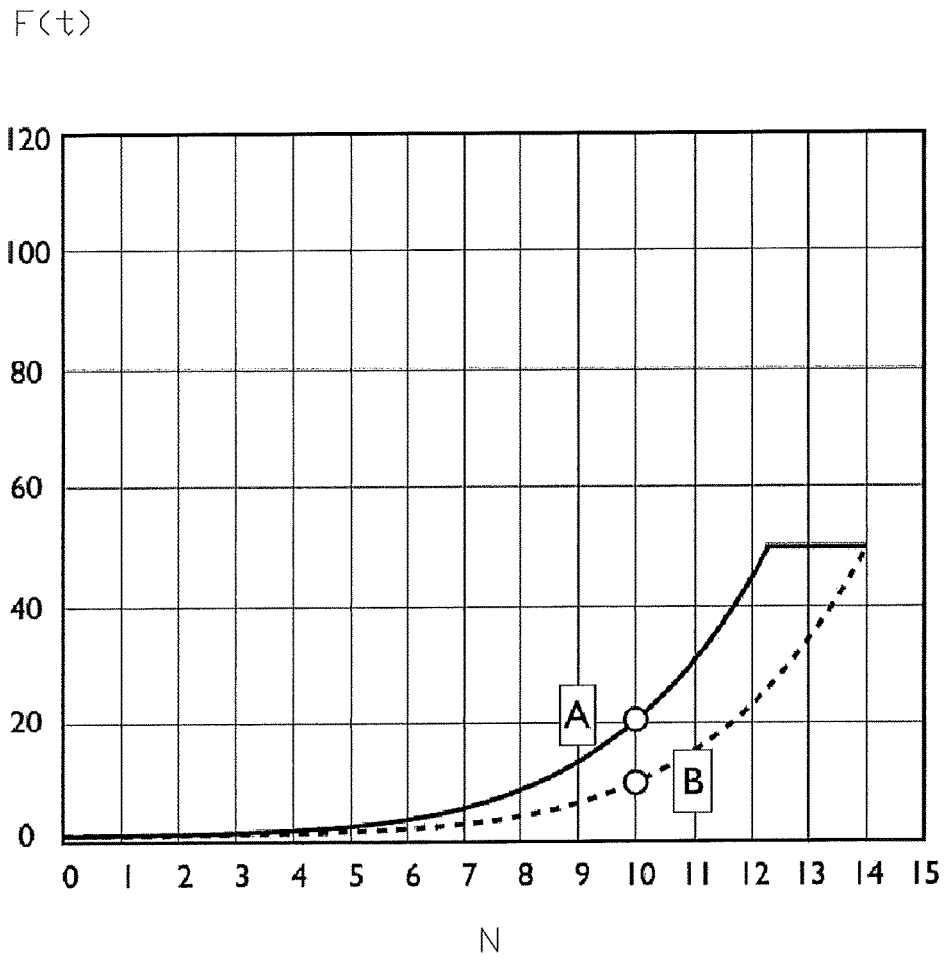

According to the present invention, one solution to overcome the above mentioned drawbacks is to regulate the tension on the low tension side 31 of the rope 3, so as to reduce for instance the big gap between points A and B in FIG. 7. Several possible solutions for regulating the tension on the low tension side are discussed above. A result of adjusting the force on the low tension side 31 can be seen from the graph in FIG. 8. The force on the high tension side 33 of the rope 3 is still 50 t, while the force on the low tension side 31 is reduced to 0.4 t. The points A and B still show the force on the $10^{th}$ sheave when lifting and lowering, respectively. The force in point A is now 20.3 t while the force in point B is still 10.4 t.

Figure 9:
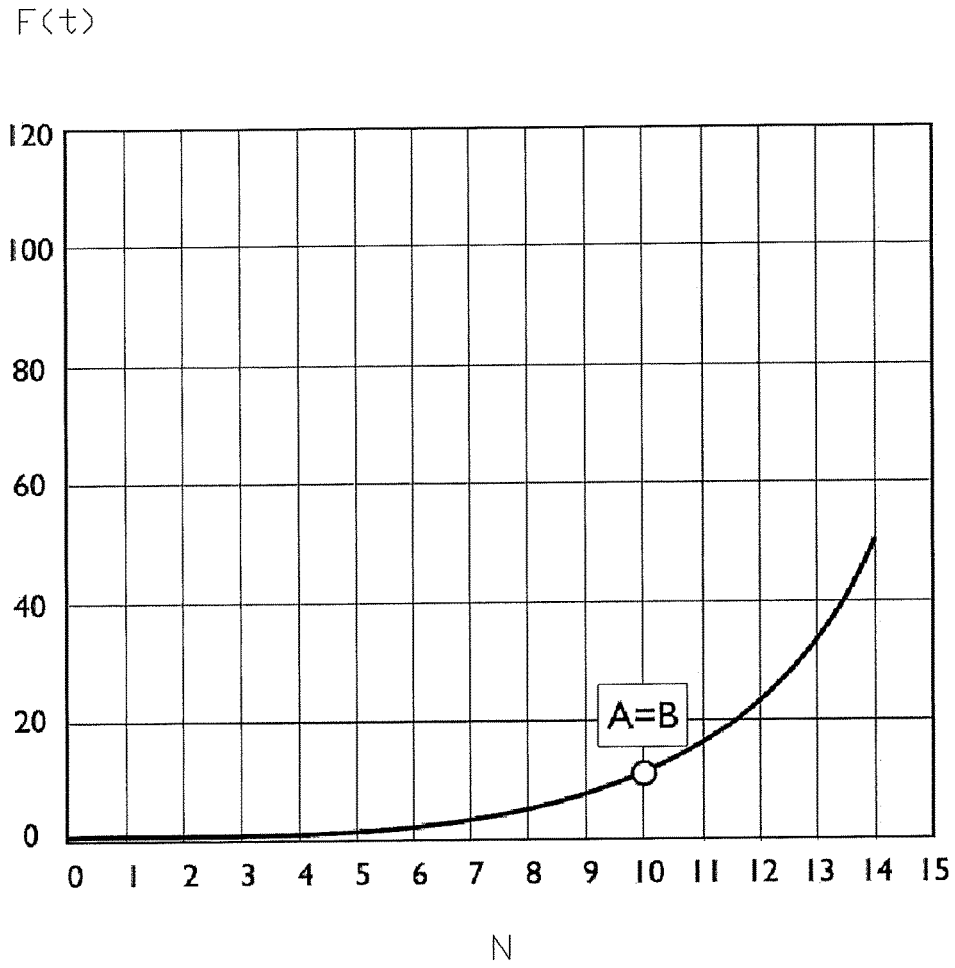

If the force on the low tension side 31 is lowered as much as to 0,205 t, the curves for lifting and lowering, and thus the points A and B will coincide like shown in FIG. 9. The coinciding curves imply that no substantial changes in rope force will occur when changing from lifting to lowering. The two curves become identical when the force on the low tension side is equal to the force on the high tension side divided by the amplification or reduction factor of the capstan:

$$\frac{S_1}{S_2} \leq e^{\mu\alpha}$$

This means that the system is operating at or near the force on the low tension side for which the rope 3 starts sliding.

Figure 10:
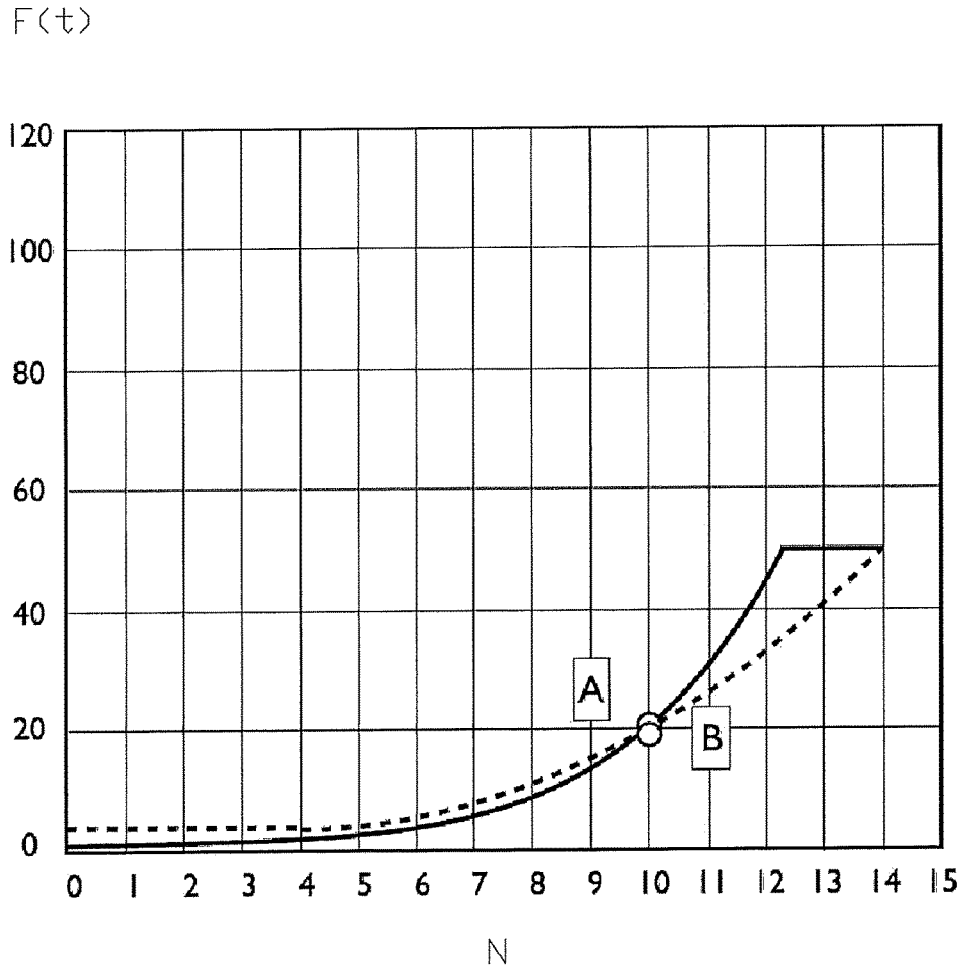

It may be beneficial to vary the rope force on the low tension side 31 of the rope 3 when the motion of the rope is reversed. In FIG. 10 an example of a force distribution in a capstan 2 is shown where the rope force on the low tension side is increased when lowering the load 5 compared to when lifting the load 5. The force distribution in the rope 3 will only change slightly over the capstan 2 and the rope 3 will be operated away from the sliding limit. Compared the dashed lines, indicating the force distribution when lowering the load 5, in FIGS. 7 and 8, the dashed line in FIG. 9 represents an increased overall load on the rope 3 when lowering the load 5. However, the changes in load levels when reversing the rope is significantly reduced. If the load level on the low tension side is reduced to a minimum when lifting and then raised when lowering the load 5, the overall load level in a capstan system can be smaller than in a system without these control mechanisms, and the changes in load level when reversing the motion will be reduced as well. Operating near a load level which creates the same load distribution for lifting and for lowering (coinciding curves like shown in FIG. 7), and slightly increasing the load level on the low tension side when lowering the load will bring both the load level and the changes to a minimum and still guarantee safe operation.

Figure 11:
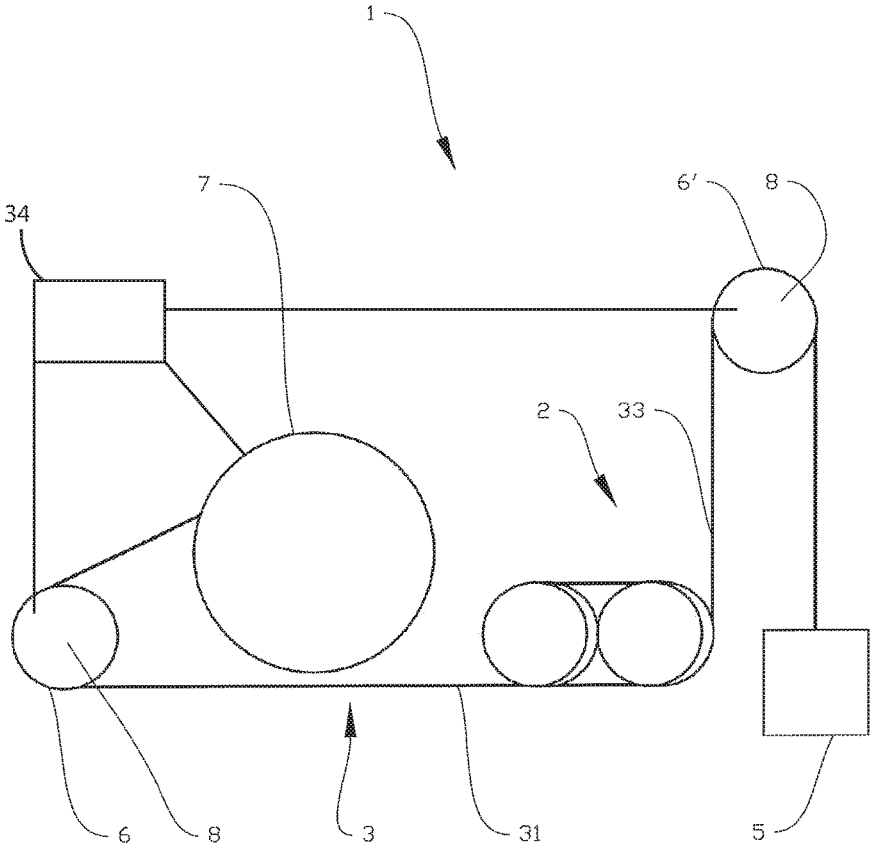
FIG. 11 shows schematically a first embodiment of a load handling device according to the present invention.

FIG. 11 shows a first embodiment of a load handling device 1 according to the present invention. The rope 3 is stored on a storage drum 7 and runs through a guide sheave 6 before it enters the capstan 2 on the low tension side 31. The rope 3 exits the capstan 2 on the high tension side 33 and runs through also a second guide sheave 6'. A load 5 is suspended from the end of the rope 3 on the high tension side 33. In the shown embodiment the storage drum 7 itself acts as a tension regulating member by adjusting the tension of the rope 3 on the low tension side 31. This embodiment may be beneficial for use in lifting and lowering operations not requiring heave compensation due to the potential large inertia of the storage drum 7. The sheaves 6, 6' are provided with load cells 8, 8' for measuring the load on the rope 3 at both the low tension side 31 and the high tension side 33. The load cells 8, 8' may further be connected to a not shown control unit 34 adapted to control the motion of the storage drum 7 based by means of a drive unit, at least partially based on the loads sensed by the load cells 8, 8'.

Figure 12:
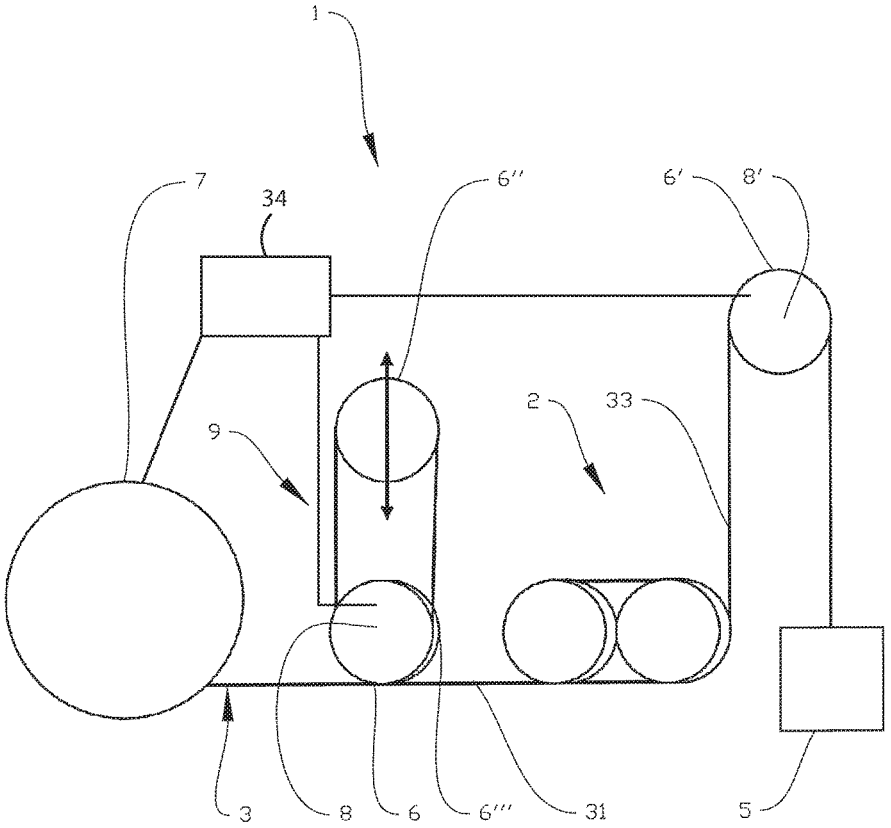
FIG. 12 shows schematically a second embodiment of a load handling device according to the present invention.

FIG. 12 shows an alternative embodiment of the load handling device 1. A separate tension control system 9 is provided between the storage drum 7 and the capstan 2 for regulating the tension on the rope 3 on the low tension side 31 as explained above. The tension control system 9 is adapted to respond quickly to the motion of the load, so as to adjust the tension of the rope 3 on the low tension side also in heave compensation operations. In the shown embodiment the tension control 9 system comprises three sheaves 6, 6", 6". In the direction from the capstan towards 2 the storage drum 7, the rope 3 travels 90° over a first sheave 6 with a fixed position. The rope 3 then travels 180° over a second sheave 6" which can be moved up or down by a not shown drive unit, such as a hydraulic cylinder. Finally the rope 3 travels 90° over a third sheave 6'" with a fixed position. The rope tension can be increased by lifting the middle sheave 6" by means of the drive unit, thereby stretching the rope 3 and increasing its tension. In a similar way, the rope tension can be reduced by lowering the second sheave 6" by means of the drive unit.

The invention claimed is:

1. A load handling device for lifting and lowering a load, the load handling device comprising:

an elongated member configured to be connected to the load;

a capstan, through which the elongated member is running, the capstan constituting one of a force amplifier and a force reducer used in lifting and lowering the load, and having a plurality of sheaves that are each separately, directly and actively rotatably driven by an external force and configured to modify a force distribution in the elongated member, the capstan defining a low tension side and high tension side of the elongated member such that the force distribution in the elongated member along a sheave in the plurality of sheaves is different when the load is lifted compared to when the load is lowered;

a load sensing device provided at the high tension side of the capstan;

a tension regulating member; and a control unit that regulates the tension regulating member based on sensed loads from the load sensing device such that the tension regulating member actively regulates the tension on the low tension side of the capstan in response to the tension measured by the load sensing device on the high tension side of the capstan so as to reduce a difference between the force distribution in the elongated member along the sheave in the plurality of sheaves in the capstan when lifting the load and the force distribution in the elongated member along the sheave in the plurality of sheaves in the capstan when lowering the load and thereby reduce tension-tension fatigue in the elongated member; wherein the control unit separately drives the plurality sheaves.

2. The load handling device according to claim 1, further comprising a load sensing device on the low tension side of the capstan.

3. The load handling device according to claim 1, wherein the tension regulating member comprises a storage drum on which at least a part of the elongated member may be stored.

4. The load handling device according to claim 1, wherein the tension regulating member comprises a separate tension control system.

5. The load handling device according to claim 1, wherein the plurality of sheaves includes individually controllable sheaves, and wherein the tension regulating member comprises at least one of sheave engaging and a disengaging unit.

6. The load handling device according to claim 1, wherein the sheave in the plurality of sheaves is at least partially made from a material with a higher friction coefficient than steel.

7. The load handling device according to claim 1, wherein the control unit is connected to a storage unit.

8. A vessel comprising a load handling device for lifting and lowering a load, the load handling device comprising:

an elongated member configured to be connected to the load;

a capstan through which the elongated member is running, the capstan constituting one of a force amplifier and a force reducer, and having a plurality of sheaves that are each separately, directly and actively rotatably driven by an external force and configured to modify a force distribution in the elongated member, the capstan defining a low tension side and high tension side of the elongated member such that the force distribution in the elongated member along a sheave in the plurality of sheaves is different when the load is lifted compared to when the load is lowered;

a load sensing device provided at the high tension side of the capstan;

a tension regulating member; and a control unit that regulates the tension regulating member based on sensed loads from the load sensing device such that the tension regulating member actively regulates the tension on the low tension side of the capstan in response to the tension measured by the load sensing device on the high tension side of the capstan so as to reduce a difference between the force distribution in the elongated member along the sheave in the plurality of sheaves in the capstan when lifting the load and the force distribution in the elongated member along the sheave in the plurality of sheaves in the capstan when lowering the load and thereby reduce tension-tension fatigue in the elongated member; wherein the control unit separately drives the plurality sheaves.

9. A method for lowering and lifting a load via a load handling device for lifting and lowering a load, the load handling device comprising:

an elongated member configured to be connected to the load;

a capstan through which the elongated member is running, the capstan constituting one of a force amplifier and a force reducer, and having a plurality of sheaves that are each separately, directly and actively rotatably driven by an external force and configured to modify a force distribution in the elongated member, the capstan defining a low tension side and high tension side of the elongated member such that the force distribution in the elongated member along a sheave in the plurality of sheaves is different when the load is lifted compared to when the load is lowered;

a load sensing device provided at the high tension side of the capstan;

a tension regulating member; and a control unit that regulates the tension regulating member based on sensed loads from the load sensing device such that the tension regulating member regulates the tension on the low tension side of the capstan in response to the tension measured by the load sensing device on the high tension side of the capstan so as to maintain a predetermined force distribution in the elongated member within the capstan; the method comprising:

measuring the tension on the high tension side of the capstan via the load sensing device; and actively regulating, via the tension regulating member, the tension on the low tension side of the capstan in response to the tension measured by the load sensing device on the high tension side of the capstan so as to reduce a difference between the force distribution in the elongated member along the sheave in the plurality of sheaves in the capstan when lifting the load and the force distribution in the elongated member along the sheave in the plurality of sheaves in the capstan when lowering the load and thereby reduce tension-tension fatigue in the elongated member; wherein the control unit separately drives the plurality sheaves.

10. A method according to claim 9, further comprising:

adjusting the tension on the low tension side of the elongated member via the tension regulating member so that the force distribution in the elongated member in the capstan when lifting the load is essentially equal to the force distribution in the elongated member in the capstan when lowering the load by:

increasing the tension on the low tension side of the elongated member when lowering the load compared to when lifting the load; and lowering the tension on the low tension side of the elongated member when lifting the load compared to when lowering the load.

11. The load handling device according to claim 1, wherein the tension regulating member comprises a sheave engaging and disengaging unit for engaging and disengaging one or more sheaves in the plurality of sheaves, wherein the controller is configured to alternately control the sheave engaging and disengaging unit to engage the one or more sheaves to thereby cause the one or more sheaves to rotate and to disengage the one or more sheaves to thereby allow the one or more sheaves to freely rotate.

12. The load handling device according to claim 1, wherein the tension regulating member comprises a storage drum configured to store a portion of the elongated member and three sheaves in the plurality of sheaves, wherein in a direction from the capstan towards the storage drum, the elongated member travels 90 degrees over a first sheave of the three sheaves, the first sheave being in a fixed position, then 180 degrees over a second sheave of the three sheaves, which second sheave being movable up and down by a drive unit, and then 90 degrees over a third sheave of the three sheaves, the third sheave being in a fixed position, wherein the tension regulating member regulates tension in the elongated member by moving the second sheave.

* * * * *